US007961558B2

(12) United States Patent
Ozawa et al.

(10) Patent No.: US 7,961,558 B2
(45) Date of Patent: Jun. 14, 2011

(54) TIMEPIECE

(75) Inventors: Noriaki Ozawa, Nagano (JP); Osamu Takahashi, Nagano (JP); Masatoshi Moteki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 471 days.

(21) Appl. No.: 12/205,387

(22) Filed: Sep. 5, 2008

(65) Prior Publication Data

US 2009/0073816 A1 Mar. 19, 2009

(30) Foreign Application Priority Data

Sep. 14, 2007 (JP) ..... 2007-240051

(51) Int. Cl.
*G04B 37/00* (2006.01)
*G04B 39/00* (2006.01)
*A44C 5/00* (2006.01)

(52) U.S. Cl. ..... 368/88; 368/281; 368/294; 368/300

(58) Field of Classification Search ..... 368/88, 368/276, 281, 294–295, 297–300, 309, 310
See application file for complete search history.

(56) References Cited

U.S. PATENT DOCUMENTS

| | | | | |
|---|---|---|---|---|
| 3,756,017 | A * | 9/1973 | Genta | 368/291 |
| 4,493,562 | A * | 1/1985 | Gagnebin | 368/294 |
| 4,696,577 | A * | 9/1987 | Muller et al. | 368/276 |
| 4,740,935 | A * | 4/1988 | Gogniat | 368/294 |
| 5,033,035 | A * | 7/1991 | Affolter | 368/294 |
| 2002/0131332 | A1 * | 9/2002 | Kaelin et al. | 368/281 |
| 2008/0101165 | A1 * | 5/2008 | Cretin et al. | 368/297 |
| 2009/0046542 | A1 * | 2/2009 | Saunier | 368/288 |

FOREIGN PATENT DOCUMENTS

| | | |
|---|---|---|
| EP | 1 241 541 A1 | 9/2002 |
| EP | 1 515 202 A1 | 3/2005 |
| JP | 2000-205222 A | 7/2000 |

* cited by examiner

*Primary Examiner* — Vit W Miska
(74) *Attorney, Agent, or Firm* — Global IP Counselors, LLP

(57) ABSTRACT

A timepiece having a movement, a substantially cylindrical case that houses the movement, a bezel that holds the outside edge part of a crystal and is fastened to the case, and a back cover that is fastened to the opposite side of the case as the side to which the bezel is disposed. The case has a plurality of movement fastening units for fastening the movement by means of screws, a plurality of bezel fastening units for fastening the bezel by means of screws, and a plurality of back cover fastening units for fastening the back cover by means of screws. The screws disposed to the movement fastening units, the bezel fastening units, and the back cover fastening units are substantially aligned with the axial direction of the case. The movement fastening units, the bezel fastening units, and the back cover fastening units are respectively disposed at different positions in the circumferential direction of the case, and are disposed to a fastener reference position substantially similar in shape to the shape of the outside of the movement facing the case.

11 Claims, 10 Drawing Sheets

TIMEPIECE

BACKGROUND

1. Field of Invention

The present invention relates generally to a timepiece. More particularly, the invention relates to a structure for fastening the case, the bezel, the back cover and other external parts, and the movement.

2. Description of Related Art

In conventional timepieces, and particularly timepieces that are highly water resistant, the bezel 94 is usually press fit to the top edge of the case 92 with intervening annular plastic packing PK as shown in FIG. 10. The plastic packing used around the bezel is harder than rubber packing and is used as a fastening member for fastening bezel to the case in addition to being used to provide water resistance. As also shown in FIG. 10, a common method of fastening the back cover of a water resistant timepiece is to thread the outside edge of the back cover 95, which effectively becomes a screw, and screw the back cover 95 into the inside edge of the case 92.

The movement 91 is fastened to the case 92 with screws into fastening parts formed on the inside circumference part of the case 92 and to a cylindrical spacer 96 at approximately two places on the outside of the movement 91.

Because the prescribed removal force of the plastic packing between the bezel and the case member is assured in a structure that uses plastic packing around the bezel by increasing the thickness of the bezel in the thickness direction of the timepiece, the bezel and case necessarily become thicker through the thickness direction of the timepiece in order to ensure the prescribed fastener strength.

In addition, if the back cover screws to the case, the back cover and case member require a prescribed material thickness and size in the thickness direction of the timepiece in order to form threads on the back cover and case member, and the back cover and case necessarily become thick and large.

A problem with the conventional method of fastening the bezel, movement, and back cover, therefore, is that because the full circumference of the bezel, the full circumference of the movement, and the full circumference of the back cover are used for fastening, these fastening structures cannot be neatly arranged in the same space, and the case member becomes bulkier than the thickness and diameter required to achieve the required fastening strength. More specifically, space is needed around the outside of the timepiece for fastening by means of the plastic packing, screwing in the back cover, and fastening the movement with screws, the fasteners for the movement must be located to not interfere with the plastic packing that secures the bezel, and the fastener of the back cover must be located to not interfere with the fasteners of the movement, and the diameter of the case thus increases.

As a result of using different fastening means for the bezel, back cover, and movement, the bezel, back cover, and movement become thicker, and the timepiece becomes larger and heavier. Note that the problem is that the fastening means for the bezel, the back cover, and the movement are designed separately, and an increase in the timepiece diameter is unavoidable even when the back cover is fastened by a screw as taught in Japanese Unexamined Patent Appl. Pub. JP-A-2000-205222, for example.

SUMMARY

A fastening structure for the case member, bezel, back cover, and movement according to the present invention improves space efficiency and affords a thinner case member, bezel, and back cover.

A timepiece according to a first aspect of the invention has a movement, a substantially cylindrical case that houses the movement, a bezel that holds the outside edge part of a crystal and is fastened to the case, and a back cover that is fastened to the opposite side of the case as the side to which the bezel is disposed. The case has a plurality of movement fastening units for fastening the movement by means of screws, a plurality of bezel fastening units for fastening the bezel by means of screws, and a plurality of back cover fastening units for fastening the back cover by means of screws. The screws disposed to the movement fastening units, the bezel fastening units, and the back cover fastening units are substantially aligned with the axial direction of the case. The movement fastening units, the bezel fastening units, and the back cover fastening units are respectively disposed at different positions in the circumferential direction of the case, and are disposed to a fastener reference position substantially similar in shape to the shape of the outside of the movement facing the case.

Screws are the means of fastening the bezel, back cover, and movement to the case in this aspect of the invention. Unlike press fitting with packing or screwing in the back cover, screws are fastening means that can be disposed in discrete locations. The entire circumference of the bezel, the entire circumference of the back cover, and the entire circumference of the movement are therefore not needed for fastening, the movement fastening units, the bezel fastening units, and the back cover fastening units can be disposed at mutually offset positions around the circumference of the case, and the fastening units can be positioned to a fastener reference position that substantially conforms to the outside of the movement. As a result, the fastening units can all be disposed to positions near the outside of the movement, thus improving space efficiency. As a result, the case rendered with the fastening units, and the bezel and back cover fastened to the case, can be made thin. The diameter of the case, the bezel, and the back cover is therefore not needlessly greater than the size of the movement.

The same screws can also be used for the movement fastening units, the bezel fastening units, and the back cover fastening units. More specifically, by using the same screw configuration in the fastening means of the movement, the bezel, and the back cover, production is simplified and management of repair parts is simplified.

In addition, by using screws for fasteners, thick material is not necessary outside of the parts that hold the screws, and the bezel, the case, and the back cover can therefore be made lighter than in a fastening structure that uses the entire circumference of the bezel, the movement, and the back cover. Furthermore, because material can be removed from the case outside of where the screws are fastened, less material is needed to manufacture the case, and the cost can be greatly reduced particularly in luxury timepieces that use solid gold, for example.

Furthermore, because the bezel fastening structure of the related art requires a tool to remove the bezel, the bezel and case are susceptible to scratching. However, by disposing the movement fastening units, the bezel fastening units, and the back cover fastening units of the invention at different positions in the circumferential direction of the case, the screws fastened in the bezel fastening units can be removed from the back cover side, and the bezel can therefore be removed without being scratched.

The movement fastening units, the bezel fastening units, and the back cover fastening units are formed as protrusions from the inside wall of the case, for example.

Preferably, an annular elastic member intervenes along the circumferential direction of the case between the bezel and the case and between the back cover and the case.

At the joint between the bezel and the case, this aspect of the invention uses screws for fastening the bezel with the case, and uses rubber packing or other elastic member to provide water resistance between the bezel and the case. At the joint between the back cover and the case, this aspect of the invention uses screws for fastening the back cover with the case, and uses rubber packing or other elastic member to provide water resistance between the back cover and the case. As a result, the bezel and back cover that are thick in a conventional water resistant timepiece can be rendered thin.

By thus using screw fasteners as the fastening means of the bezel, the back cover, and the movement, and using elastic members as the water resistance means separately from the screws used as the fastening means, space efficiency can be greatly improved in a water resistant timepiece.

Further preferably, the case and movement are substantially round in plan view, and the movement fastening units, the bezel fastening units, and the back cover fastening units are located at the same radial position from the plane center of the movement.

By thus disposing the movement fastening units, the bezel fastening units, and the back cover fastening units to a substantially circular fastener reference position around the outside part of the movement, the base, the bezel, and the back cover can be made thin.

Further preferably, at least two of the movement fastening units, the bezel fastening units, and the back cover fastening units that are adjacent in the circumferential direction of the case are mutually contiguous.

This aspect of the invention makes processing the inside circumference part of the case easier than when the movement fastening units, the bezel fastening units, and the back cover fastening units are all formed separately.

For processing, the movement fastening units, the bezel fastening units, and the back cover fastening units that are at the same or proximate positions in the thickness direction of the timepiece are preferably formed contiguously.

In another aspect of the invention a space including a portion along the axial direction of the screws disposed to the bezel fastening units is formed to the case or to the inside of the case when the movement is housed in the case.

This aspect of the invention enables inserting the screws to the bezel fastening units and removing the screws fastened in the bezel fastening units through this space. The bezel can therefore be removed from the case while the movement remains assembled to the case, and thus enables easily replacing the dial, for example, after the timepiece is assembled.

Further preferably, the timepiece also has a case member including the case, the movement fastening units, the bezel fastening units, and the back cover fastening units, and an antimagnetic member disposed on the side of the case member facing the movement. The antimagnetic member is formed to substantially fill the space between the movement and the case member except in the parts where the movement fastening units, the bezel fastening units, and the back cover fastening units are disposed.

Because the antimagnetic member is disposed substantially filling the space between the movement and the case member except in the parts around the circumference of the case member where the movement fastening units, the bezel fastening units, and the back cover fastening units are disposed, the volume of the antimagnetic member can be increased compared with a conventional antimagnetic plate. This improves antimagnetic performance. The antimagnetic plate of the related art is a simple cylinder, but the precision construction having substantially no gap inside the case member between the antimagnetic member and the movement creates a luxury product feel. The antimagnetic member of the invention can also be formed according to the shape of the wheel train bridges and base plate of the movement, and the complex shape of the antimagnetic member improves the appeal of the timepiece.

In another aspect of the invention the diameter of the elastic member intervening between the case and the bezel, and the diameter of the elastic member intervening between the case and the back cover, are the same.

It is difficult with the configuration of the related art to make the diameter of the elastic member used at the bezel and the diameter of the elastic member used at the back cover the same. However, because the fastening structures of the bezel, case, back cover, and movement in the invention improve space efficiency as described above, and the bezel fastening units and back cover fastening units can be disposed within the same radius, elastic members of the same diameter can be used with the bezel and the back cover. Furthermore, because the functions of fastening and providing water resistance at the bezel are separated between the screws and elastic member, a rubber elastic member can be used instead of a plastic member for the elastic member used with the bezel. More particularly, because the same rubber elastic members can be used for the elastic member used with the bezel and the elastic member used with the back cover, parts management of the consumable elastic members (packing) is simplified.

Further preferably, the back cover includes an annular back cover ring and a back crystal disposed to an inside circumference part of the back cover ring, and the back cover ring is disposed to a position hiding the back cover fastening units.

Because the space efficiency of the fastening structure for the movement, the bezel, and the back cover is high and the width of the back cover ring that hides the back cover fastening units is narrow, the area where glass can be disposed in the back cover can be increased. The precision parts in the movement, including wheel trains and levers, can therefore be seen through the back crystal over a large part of the back cover, and the external design of the timepiece can be improved.

The timepiece according to according to another aspect of the invention also has an engaging unit that protrudes in the axial direction of the case from at least one of the bezel and the back cover, and engages a part of the case in the circumferential direction of the case.

Because the engaging unit (boss) in this aspect of the invention reinforce the holding power of the screws, the screws can be prevented from breaking as a result of the shear strength produced between the bezel and the case and between the back cover ring and the case from the force of impact when the timepiece is dropped, for example. More specifically, the bezel and the case, and the back cover and the case can be fastened more reliably and impact resistance can be improved. The size of the screws can therefore be reduced.

To further improve shock resistance, a plurality of engaging units (bosses) are preferably formed at discrete positions circumferentially to the bezel or back cover.

Yet further preferably, a space is formed to the case including a portion along the axial direction of the screws disposed to one or both of the movement fastening units and bezel fastening units.

In this aspect of the invention the spaces for inserting the screws to the bezel fastening units and movement fastening units also function as parts engaged by the bosses, and the need to separately render parts for engaging the bosses on the case can be eliminated. Impact resistance can thus be improved without complicating processing the inside circumference part of the case.

Another aspect of the invention is a timepiece having a movement; a case that has a substantially cylindrical case member and a cover, and houses the movement; and a bezel that holds the outside edge part of a crystal and is fastened to the case member. The case member has a plurality of movement fastening units for fastening the movement by means of screws, and a plurality of bezel fastening units for fastening the bezel by means of screws. The screws disposed to the movement fastening units and the bezel fastening units are substantially aligned with the axial direction of the case member. The movement fastening units and the bezel fastening units are respectively disposed at different positions in the circumferential direction of the case, and are disposed to a fastener reference position substantially similar in shape to the shape of the outside of the movement facing the case member.

In this aspect of the invention the case is a single piece including the case member and the back cover. As in the timepiece of the invention described above, the movement fastening units and the bezel fastening units are disposed to a fastener reference position along the outside of the movement. Space efficiency is thus improved and the this aspect of the invention achieves the same effects described above.

The fastening structure for the case member, bezel, back cover, and movement according to the invention improves space efficiency and affords a thinner case member, bezel, and back cover.

Other objects and attainments together with a fuller understanding of the invention will become apparent and appreciated by referring to the following description and claims taken in conjunction with the accompanying drawings.

DESCRIPTION OF PREFERRED EMBODIMENTS

A preferred embodiment of the present invention is described below with reference to the accompanying figures.

1. General Configuration

Figure 1:
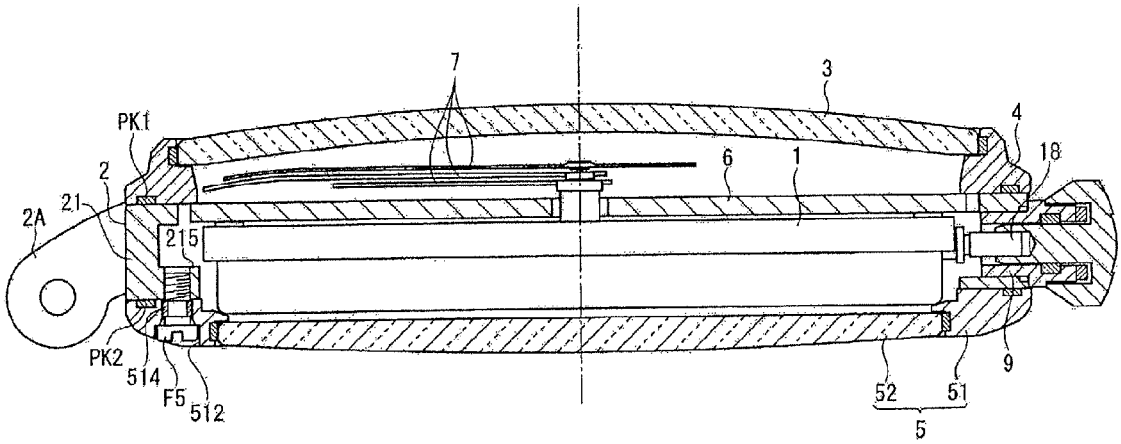
FIG. 1 is a vertical section view of a timepiece according to a preferred embodiment of the invention.
Figure 2:
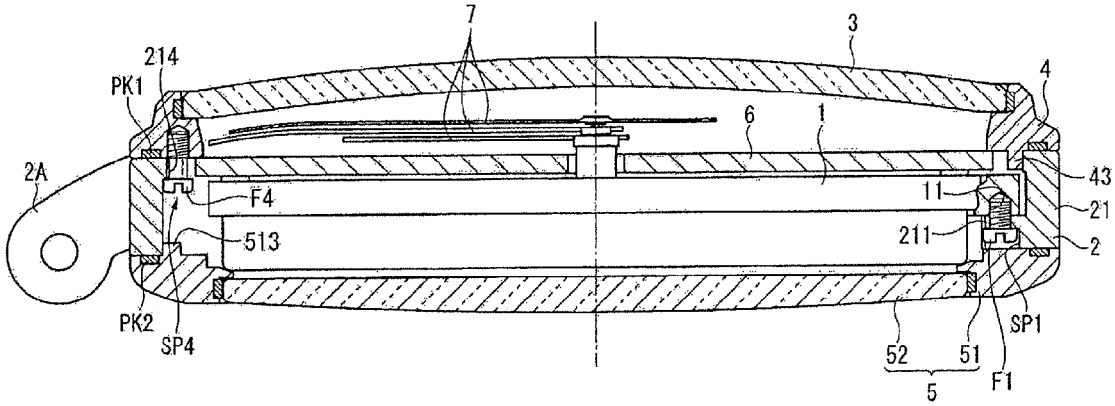
FIG. 2 is a vertical section view of a timepiece according to a preferred embodiment of the invention.
Figure 3:
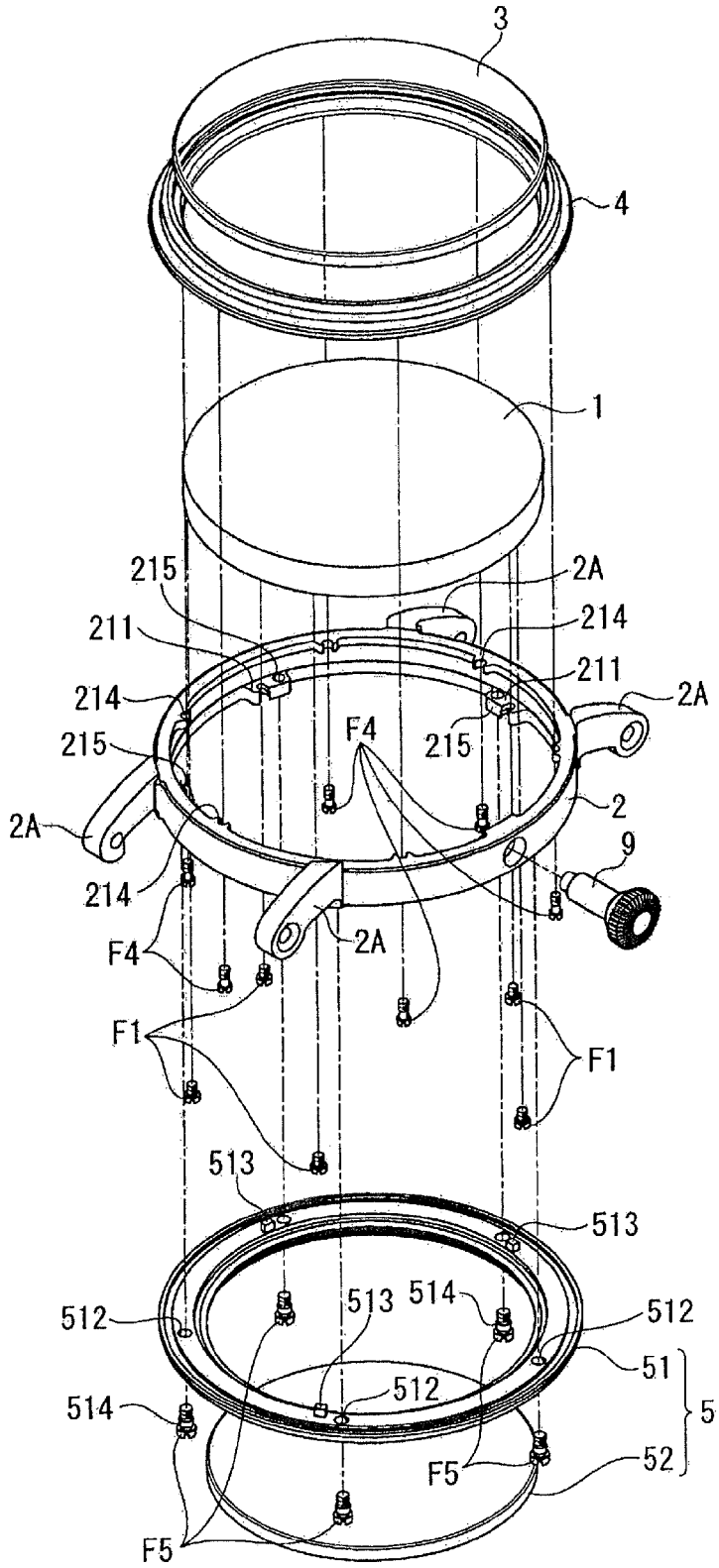
FIG. 3 is an exploded oblique view of the movement, case member, bezel, and back cover of a timepiece according to a preferred embodiment of the invention.

FIG. 1 and FIG. 2 are vertical section views of a timepiece according to a preferred embodiment of the invention, and FIG. 3 is an exploded oblique view of the timepiece. Note that in FIG. 1 the left side of the vertical center line is a section view to the 12:00 o'clock side of the timepiece, and the right side is a section view to the 3:00 o'clock side.

The timepiece according to this embodiment of the invention has a movement 1, a substantially cylindrical case 2 that houses the movement 1, a crystal 3, an annular bezel 4 that holds the outside edge part of the crystal 3, and a back cover 5 disposed to the case 2 on the opposite side as the crystal 3.

The movement 1 includes a hair spring or other drive power source, a drive wheel train, a governor mechanism, and a stepping motor, for example.

The back cover 5 includes an annular back cover ring 51 and a back crystal 52 disposed to the inside circumference part of the back cover ring 51.

The timepiece according to this embodiment of the invention is an electronically controlled mechanical timepiece that drives hands using drive power from a hair spring, and supplies power generated using the drive force of the hair spring to an electronic circuit to govern operation, but the drive method of the movement is not so limited. The timepiece in this embodiment of the invention could be an electronic timepiece or a mechanical timepiece.

Note that as shown in FIG. 1 and FIG. 2 a dial 6, hands 7, and stem 8 are disposed to the movement 1. A watch band is attached to the lugs 2A.

The movement 1 is fastened by five screws F1 (FIG. 2 and FIG. 3) to the case 2. The bezel 4 is fastened by six screws F4 (FIG. 2, FIG. 3) to the case 2. The back cover 5 is fastened by five screws F5 (FIG. 1, FIG. 3) to the case 2. The screws F1, F4, and F5 are disposed substantially parallel to the axis of the case 2. An O-ring 514 is disposed around the shank of the screws F5.

2. Case Construction

Figure 4:
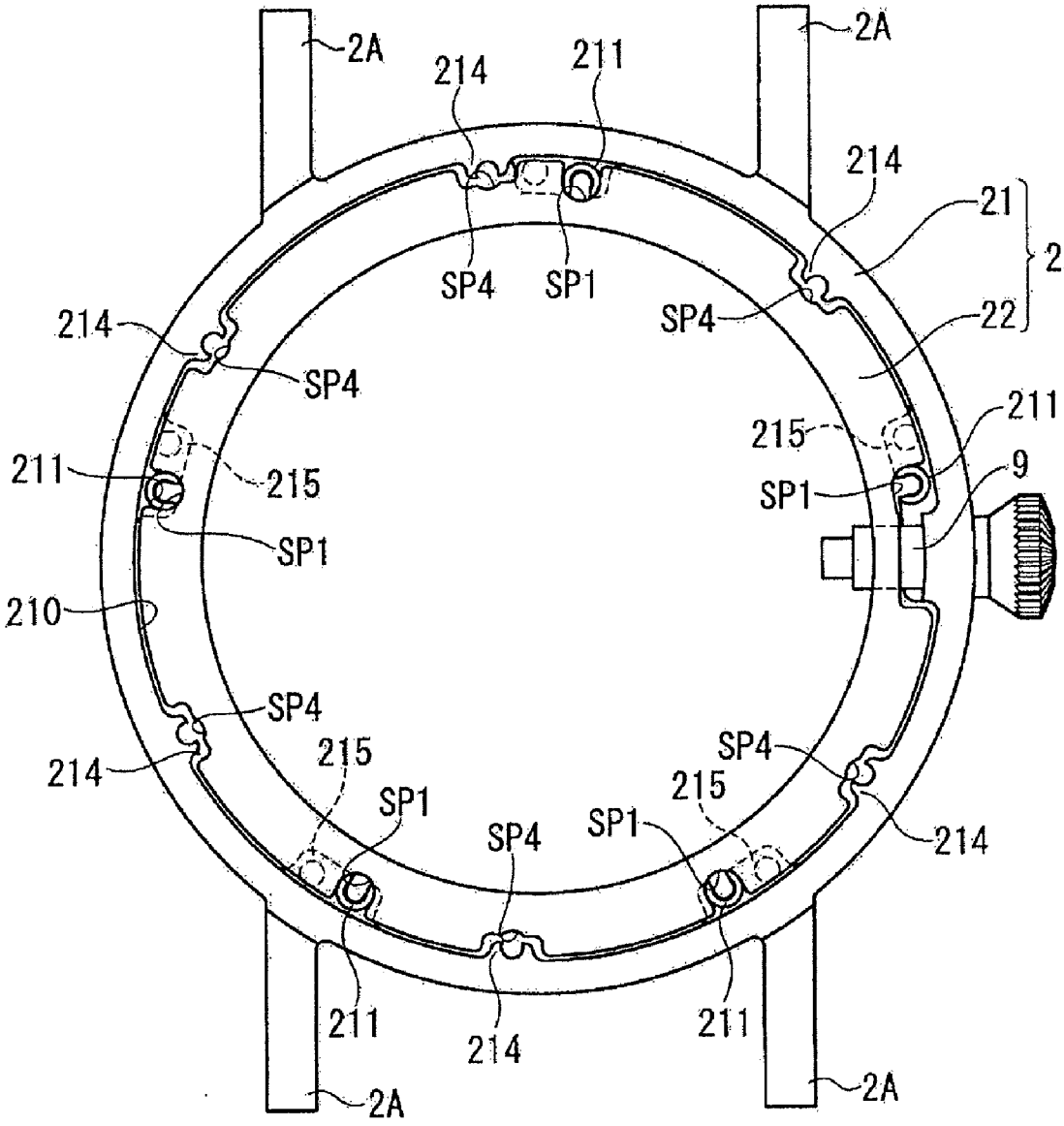
FIG. 4 is a plan view of the case and antimagnetic member from the crystal side of the timepiece.

FIG. 4 is a schematic plan view of the case 2. The case 2 has a substantially cylindrical case member 21, and an antimagnetic member 22 disposed on the side of the case member 21 facing the movement 1. The antimagnetic member 22 prevents external magnetic fields from magnetizing the wheel train and causing the stepping motor operate incorrectly.

2-1 Case Member Construction

Figure 5:
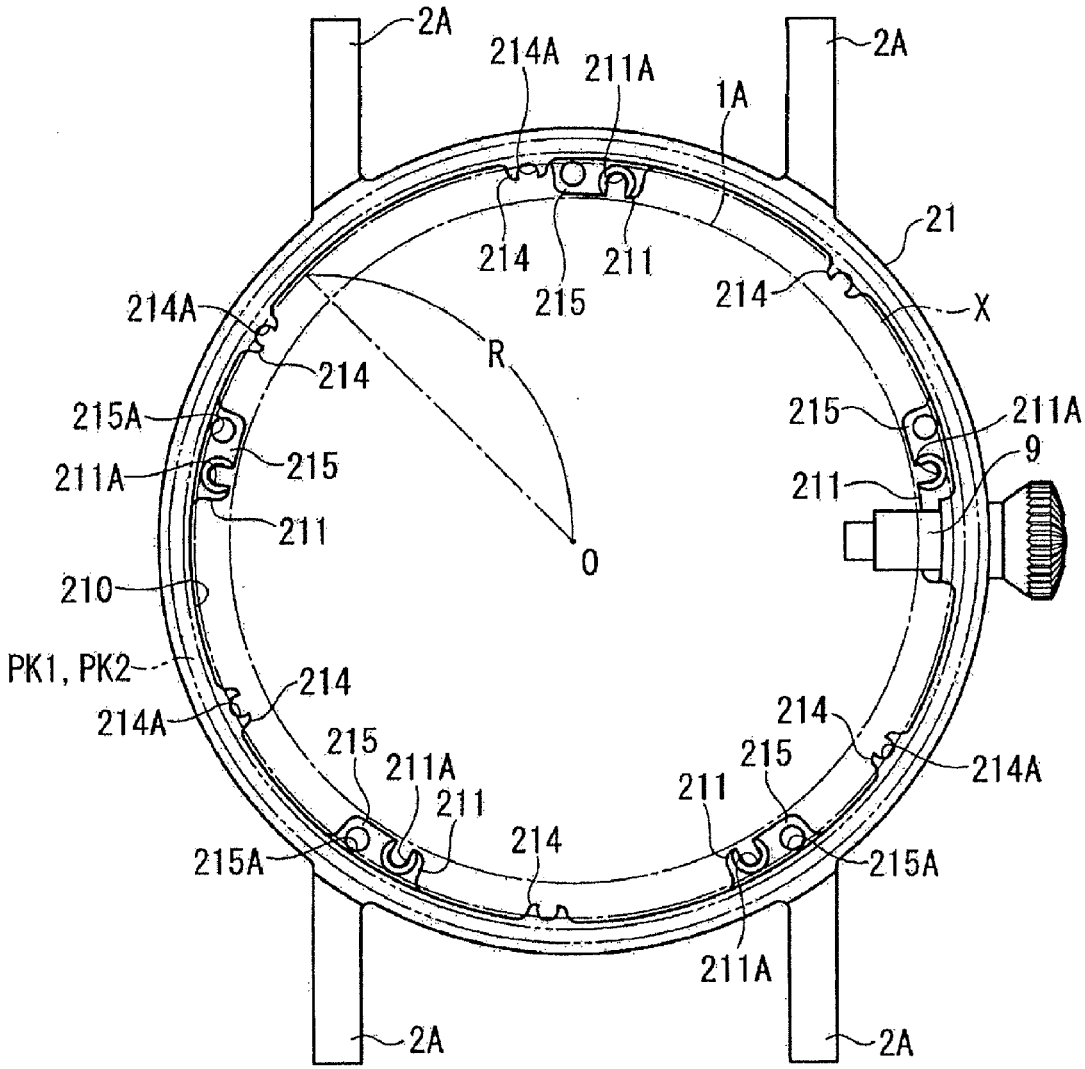
FIG. 5 is a plan view of the case from the crystal side of the timepiece.

FIG. 5 is a plan view from the crystal side of the case member 21. The case member 21 is formed by three-dimensional cutting and polishing processes, and includes five movement fastening units 211 for fastening the movement 1, six bezel fastening units 214 for fastening the bezel 4, and five back cover fastening units 215 for fastening the back cover 5. The material of the case member 21 is not specifically limited, but this embodiment of the invention uses a solid gold material.

The movement fastening units 211, bezel fastening units 214, and back cover fastening units 215 are respectively disposed at different positions around the circumference of the inside wall 210 of the case member 21.

The movement 1 includes different wheel trains, levers, wheel train bridges, a base plate, pressure plates, and a stepping motor, and the outside profile of the movement 1 is complexly shaped with numerous bosses and recesses both the plane and thickness directions of the timepiece. However, the various components of the movement 1 are efficiently and neatly arranged, and the position 1A (dot-dash line in FIG. 5) within which most of the components of the movement 1 are contained is used as the effective outside circumference 1A of the movement 1.

The movement fastening units 211, bezel fastening units 214, and back cover fastening units 215 of the case member 21 are disposed to a round fastener reference position X that is substantially similar in shape to the effective outside circumference 1A of the movement 1. Because the movement 1 and the case member 21 are round in plan view in this embodiment of the invention, the movement fastening units 211, bezel fastening units 214, and back cover fastening units 215 are disposed within the same radius R from the plane center O of the movement 1.

The movement fastening units 211, bezel fastening units 214, and back cover fastening units 215 are also disposed to a position not interfering with the stem sleeve 9.

The bezel fastening units 214 are disposed to the case member 21 at positions near the bezel 4. The bezel fastening units 214 are holes 214A that are C-shaped in section, and the screws F4 (FIG. 2, FIG. 3) are inserted to these holes 214A.

The movement fastening units 211 and back cover fastening units 215 are disposed to the case member 21 at positions near the back cover 5. These movement fastening units 211 and back cover fastening units 215 are disposed at the same position in the axial direction of the case member 21, that is, at the same height, and the movement fastening units 211 and back cover fastening units 215 that are adjacent along the circumference of the case member 21 are mutually contiguous.

The movement fastening units 211 have holes 211A that are C-shaped in section, and the screws F1 (FIG. 2, FIG. 3) are inserted to these holes 211A.

The back cover fastening units 215 have threaded holes 215A, and the screws F5 are screwed into these threaded holes 215A.

2-2 Antimagnetic Member Construction

The antimagnetic member 22 is not shown in FIG. 4, but is complexly shaped with numerous bosses and recesses in both the plane and thickness directions of the timepiece according to the shapes of the wheel trains, levers, bridges, base plate, and pressure plates of the movement 1, for example. Like the case member 21, the antimagnetic member 22 is also formed by three-dimensional cutting and polishing processes.

The antimagnetic member 22 is formed to substantially fill the spaces between the movement 1 and the inside wall 210 of the case member 21 except where the movement fastening units 211, bezel fastening units 214, and back cover fastening units 215 are located around the circumference of the case member 21. Gaps are also formed in the antimagnetic member 22 to enable assembly between the movement 1 and the case member 21.

Spaces SP1 are formed to the antimagnetic member 22 at positions corresponding to the movement fastening units 211, and spaces SP4 are formed to the antimagnetic member 22 at positions corresponding to the bezel fastening units 214. The spaces SP1 and SP4 include portions along the axial direction of the case member 21. The spaces SP1 and SP4 pass through the antimagnetic member 22 in the thickness direction of the timepiece.

Although not shown in the figure, three recesses are formed discretely between the six bezel fastening units 214 at the outside part of the antimagnetic member 22 opposite the bezel 4.

3. Movement Fastening Structure

Screw holes 11 (FIG. 2) are formed in the movement 1 at positions corresponding to the holes 211A (FIG. 5) in the movement fastening units 211. The screws F1 (FIG. 2, FIG. 3) inserted to these holes 211A in the movement fastening units 211 are screwed into the screw holes 11 in the movement 1 to fasten the movement 1 and the antimagnetic member 22 to the case member 21. These screws F1 are inserted to the holes 211A and screw holes 11 through the spaces SP1 in the antimagnetic member 22 (FIG. 4).

4. Bezel Fastening Structure

Figure 6:
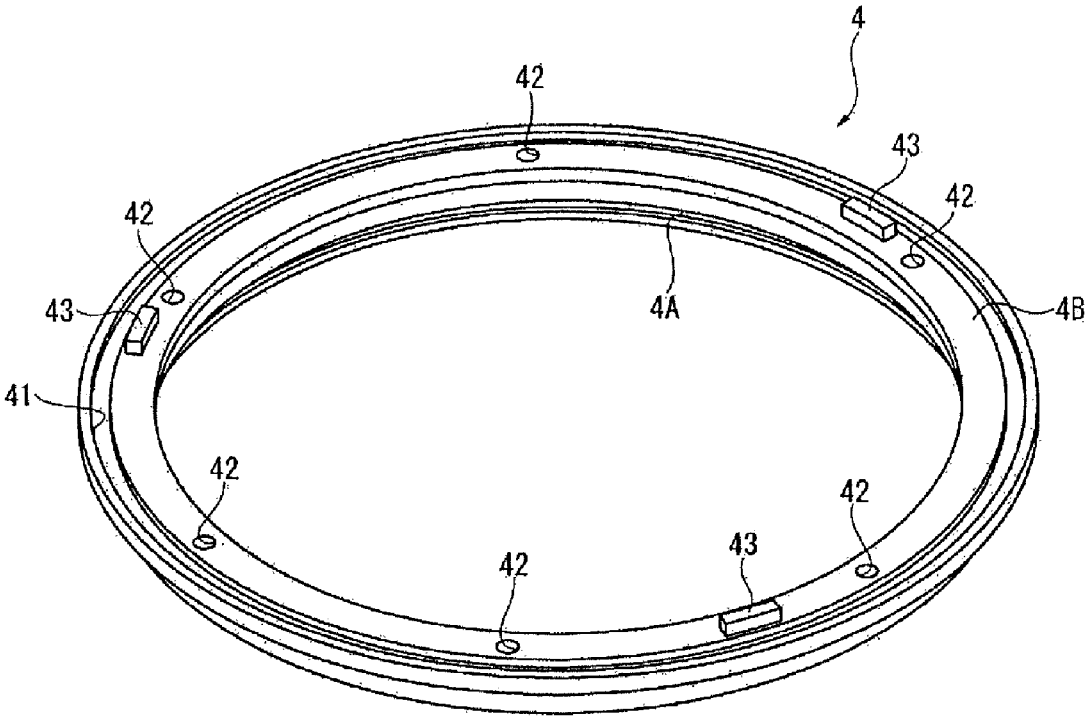
FIG. 6 is an oblique view of the back of the bezel.
Figure 7:
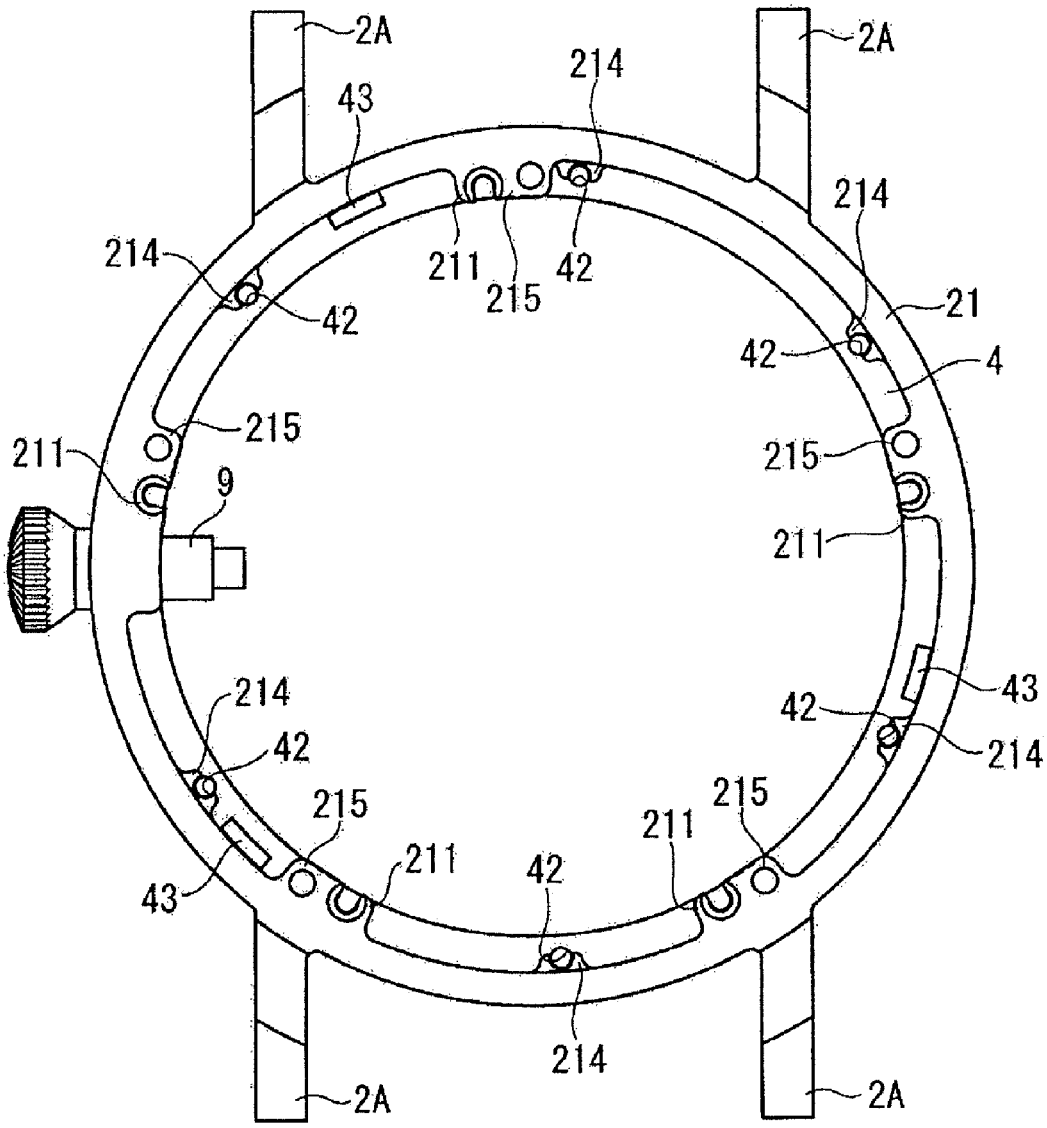
FIG. 7 is a plan view from the back cover side of the bezel and the case.

FIG. 6 is an oblique view of the bezel 4 from the back side. FIG. 7 is a plan view of the case member 21 and bezel 4 from the back cover side. Reference numeral 4A in FIG. 6 denotes a groove in which the outside edge of the crystal 3 (FIG. 3) is inserted.

As shown in FIG. 6, a channel 41 in which rubber packing PK1 (FIG. 1, FIG. 2) is disposed as an annular elastic member is formed in the back side 4B of the bezel 4, and six screw holes 42 and three bosses 43 (engaging units) are formed to the bezel 4 on the inside circumference side of this channel 41.

The screw holes 42 correspond to the bezel fastening units 214 shown in FIG. 7. The bezel 4 is fastened to the case member 21 by inserting the screws F4 (FIG. 1, FIG. 3) from the back cover side through the holes 214A in the bezel fastening units 214 and screwing the screws F4 into the screw holes 42. These screws F4 are disposed in the holes 214A in the bezel fastening units 214 and the screw holes 42 in the bezel 4 through the spaces SP4 in the antimagnetic member 22 (FIG. 4).

The bosses 43 are fit into recesses (not shown in the figure) formed in the antimagnetic member 22. The invention is not so limited, however, and the bosses 43 of the bezel 4 could be engaged with the edge portion on the bezel 4 side of spaces SP1 (FIG. 4) rendered along the axial direction of the screws F1 inserted to the movement fastening units 211.

5. Back Cover Fastening Structure

Figure 8:
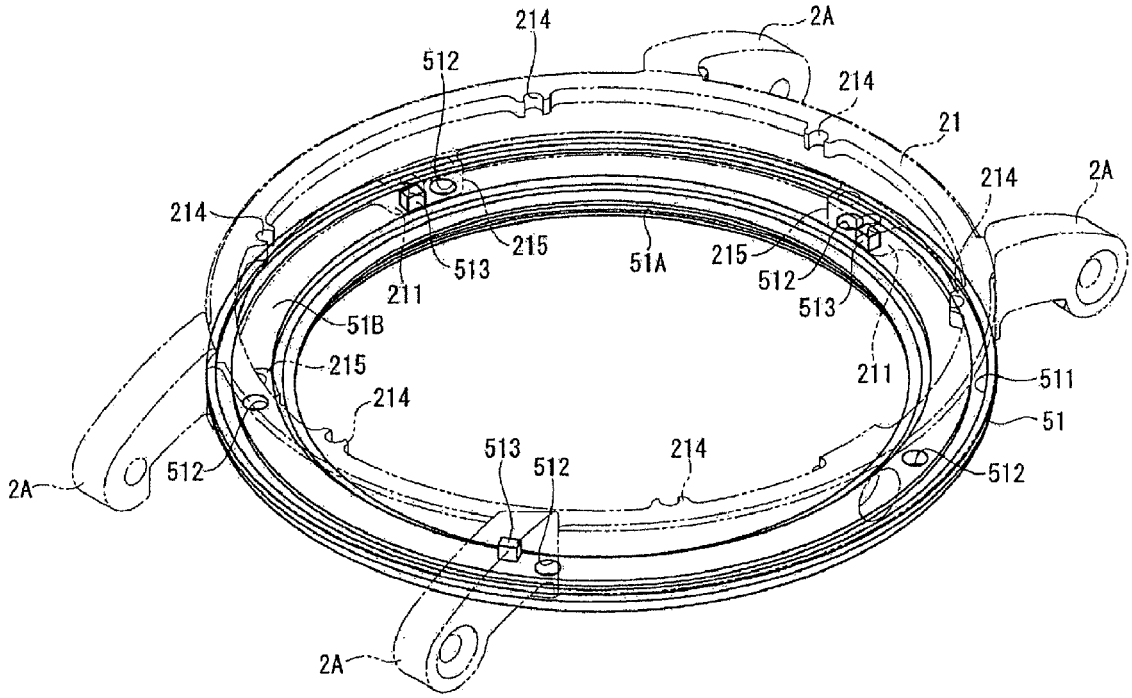
FIG. 8 is an oblique view of the case member and the back cover.

FIG. 8 is an oblique view of the case member 21 and the back cover ring 51 from the crystal side. Reference numeral 51A in FIG. 8 is a channel in which the outside edge part of the back crystal 52 (FIG. 3) is inserted.

The back cover ring 51 is disposed to a position that hides the back cover fastening units 215 and the movement fastening units 211.

A channel 511 in which rubber packing PK2 (FIG. 1, FIG. 2) is disposed as an annular elastic member is formed in the top part 51B of the back cover ring 51, and five holes 512 and three bosses 513 are formed to the back cover ring 51 on the inside circumference side of the channel 511.

The diameter of this packing PK2 (FIG. 1, FIG. 2) is the same as the diameter of the packing PK1 (FIG. 1, FIG. 2) disposed to the bezel 4.

The holes 512 correspond to the back cover fastening units 215 as shown in FIG. 8. The screws F5 (FIG. 1, FIG. 3) are inserted to the holes 512 from the opposite side of the back cover ring 51 as the top part 51B and screwed into the threaded holes 215A to fasten the back cover ring 51 to the case member 21. An O-ring 514 intervenes between the screws F5 and the holes 512, and thus renders the holes 512 water resistant.

The bosses 513 are fit to the edge portion on the back cover ring 51 side of the spaces SP1 in the antimagnetic member 22 (FIG. 4). The invention is not so limited, however, and the bosses 513 of the back cover ring 51 could be fit to the edge portion on the back cover ring 51 side of the spaces SP4 along the axial direction of the screws F4 inserted to the bezel fastening units 214.

6. Assembling the Timepiece

Assembling the timepiece configured as described above is described below with reference to FIG. 1 to FIG. 3.

The movement 1 is first placed inside the case member 21 from the top end (the side to which the crystal 3 is disposed) of the case member 21 with the antimagnetic member 22 between the movement 1 and the case member 21. The screws F1 (FIG. 2) are then inserted through the spaces SP1 of the antimagnetic member 22 from the back cover 5 side, and the movement 1 is fastened to the movement fastening units 211 with the five screws F1. This assembles the case member 21, the antimagnetic member 22, and the movement 1 into a single unit.

The bezel 4 is then set in the top of the case member 21 with the packing PK1 therebetween, and the bosses 43 (FIG. 2, FIG. 6) of the bezel 4 are fit into the recesses (not shown in the figure) of the antimagnetic member 22 to position the bezel 4 to the case member 21. Note that the bezel 4 and crystal 3 are assembled with packing therebetween. With the bezel 4 positioned to the case member 21, screws F4 (FIG. 2) are inserted through the spaces SP4 of the antimagnetic member 22 from the back cover 5 side, and the bezel 4 is fastened to the bezel fastening units 214 with the six screws F4.

The back cover ring 51 is then disposed to the bottom end part of the case member 21 with the packing PK2 therebetween, the bosses 513 (FIG. 8) of the back cover ring 51 are fit to the edge part of the spaces SP1 of the antimagnetic member 22, positioning the back cover ring 51 to the case member 21. Note that the back cover ring 51 and back crystal 52 are first assembled with packing therebetween. With the back cover ring 51 thus positioned to the case member 21, the screws F5 (FIG. 1) are inserted to the holes 512 in the back cover ring 51, and the back cover ring 51 is fastened to the back cover fastening units 215 with the six screws F4.

This completes assembly of the movement 1, the case 2, the crystal 3, the bezel 4, and the back cover 5 into a single unit. Note that water resistance is provided between the bezel 4 and the case member 21 by packing PK1, and water resistance is provided between the back cover ring 51 and the case member 21 by packing PK2.

7. Effect of this Embodiment of the Invention

This embodiment of the invention has the following effects.

(1) Because screws are used as the fastening means holding the bezel 4, the back cover 5, and the movement 1 to the case 2, and the full circumference of the bezel 4, the full circumference of the back cover 5, and the full circumference of the movement 1 are not needed for fastening to the case 2, the bezel fastening units 214, the back cover fastening units 215, and the movement fastening units 211 can be located at a fastener reference position X that substantially follows the effective outside circumference 1A of the movement 1. As a result, the fastening units 211, 214, and 215 can also be located within the same radius R of the movement 1, space efficiency is improved, and the case member 21 including these fastening units 211, 214, and 215, and the bezel 4 and back cover ring 51 fastened to the case member 21, can be made thin.

(2) By using screws instead of the full circumference of the bezel 4, the movement 1, and the back cover 5 for fastening, thick material is not necessary outside of the parts that hold the screws, the bezel 4, the case 2, and the back cover 5 can therefore be made lighter, and a timepiece with a weight that is ideal for wearing or carrying can be provided.

In addition, because the case member 21 is solid gold in this embodiment of the invention, the materials cost can be reduced because the thickness of the case member 21 can be reduced.

(3) The movement fastening units 211, bezel fastening units 214, and back cover fastening units 215 are disposed at mutually different locations around the circumference of the case member 21, and spaces SP4 are disposed to the antimagnetic member 22. The screws F4 fastened to the bezel fastening units 214 can therefore be removed from the back cover 5 side through these spaces SP4. Prying the bezel open as required by the related art is therefore not necessary, and the bezel 4 can be removed from the case member 21 without scratching.

(4) The fastening and water resistance functions of the joint between the bezel 4 and the case member 21 are separated with screws F4 fastening the bezel 4 to the case member 21 and packing PK1 providing water resistance between the bezel 4 and the case member 21. The fastening and water resistance functions of the joint between the back cover ring 51 and the case member 21 are also separated with screws F5 fastening the back cover ring 51 to the case member 21 and packing PK2 providing water resistance between the back cover ring 51 and the case member 21. By thus using elastic members as the water resistance means and screws as the fastening means, space efficiency is greatly improved in a water resistant timepiece, and the bezel and back cover that are thick in a conventional water resistant timepiece can be rendered thin.

(5) By rendering at least two of the movement fastening units 211 and back cover fastening units 215 that are mutually adjacent in the circumferential direction of the case member 21 contiguous, the inside circumference part of the case member 21 can be processed more easily than if the movement fastening units 211 and back cover fastening units 215 are formed non-contiguously.

(6) By forming spaces SP4 to the antimagnetic member 22 disposed between the case member 21 and movement 1, the screws F4 can be inserted to the bezel fastening units 214 and the screws F4 fastened to the bezel fastening units 214 can be removed through these spaces SP4. The dial 6 can also be easily replaced, for example, after assembling the timepiece because the bezel 4 can be removed from the case member 21 while the movement 1, the antimagnetic member 22, and the case member 21 remain an intact assembly.

(7) The volume of the antimagnetic member 22 can be increased compared with a conventional tubular antimagnetic plate because the antimagnetic member 22 can be disposed in the space between the movement 1 and the case member 21 except in the parts where the movement fastening units 211, bezel fastening units 214, and back cover fastening units 215 are disposed at intermittent points around the circumference of the case member 21. In addition to improving antimagnetic performance, the precision construction having the antimagnetic member 22 and movement 1 disposed with substantially no gap inside the case member 21 creates a luxury product feel. The complex shape of the antimagnetic member 22 also improves the appeal of the timepiece.

(8) Because the packing PK1 between the case member 21 and the bezel 4 and the packing PK2 between the case member 21 and the back cover ring 51 have the same diameter, managing the consumable packing PK1 and PK2 is easier.

(9) Because the space efficiency of the fastening structure for the movement 1, the bezel 4, and the back cover 5 is high and the width of the back cover ring 51 is narrow, the area of the back crystal 52 in the back cover 5 can be increased. The precision parts in the movement 1, including wheel trains and levers, can therefore be seen through the back crystal 52 over a large part of the back cover 5, and the external design of the timepiece can be improved.

(10) The holding strength of the screws F4 and F5 is increased by engaging the bosses 43 disposed to the bezel 4 with the recesses in the antimagnetic member 22 around the circumference of the case member 21, and engaging the bosses 513 of the back cover ring 51 with the edge part of the spaces SP1 in the antimagnetic member 22 around the circumference of the case member 21. This can prevent the screws F4, F5 from failing due to the shear strength produced between the bezel 4 and the case member 21 and between the back cover ring 51 and the case member 21 from the force of impact when the timepiece is dropped, for example. The size of the screws F4 and F5 can therefore be reduced.

Note that because there are three bosses 43 and bosses 513 distributed around the circumferential direction of the case member 21, resistance to impact from all directions is high.

Note that because the edge part of the spaces SP1 used for inserting the screws F1 to the movement fastening units 211 also function as a part for engaging the bosses 513, impact resistance is high without complicating processing the inside circumference part of the case member 21.

Figure 9:
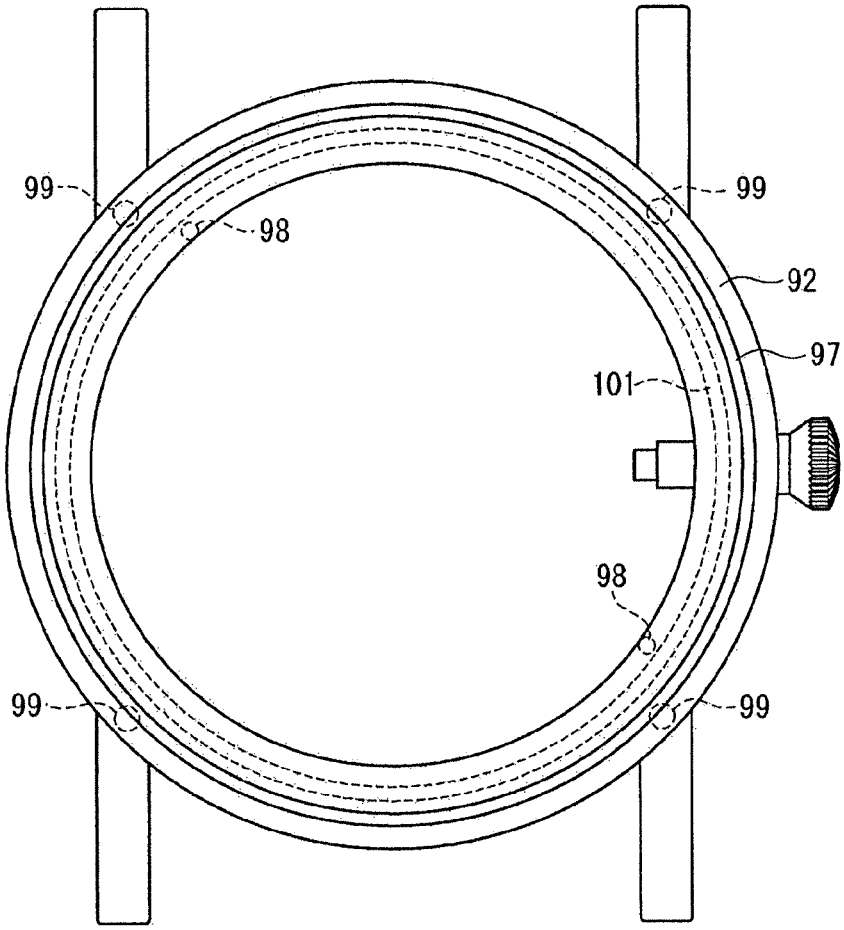
FIG.9 (PRIOR ART)
FIG. 9 shows an example of the related art for comparison with the invention.
Figure 10:
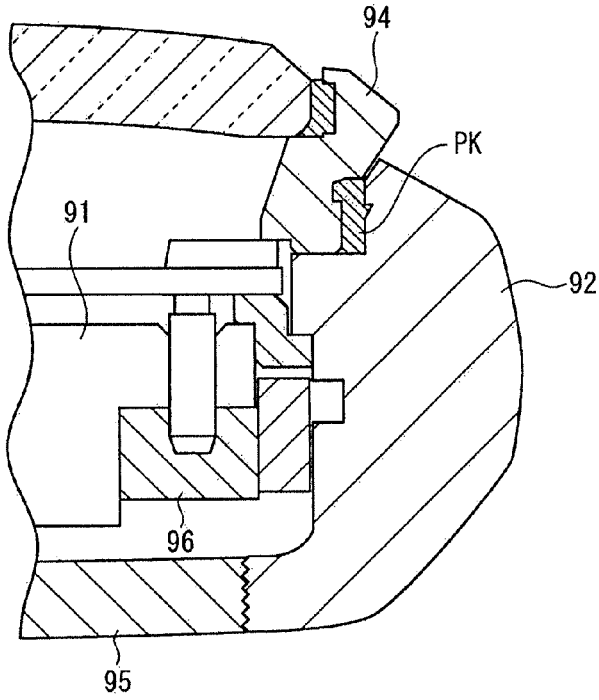
FIG.10 (PRIOR ART)
FIG. 10 is a vertical section view of a timepiece according to the related art.

The construction of a timepiece according to the related art is shown in FIG. 9 for comparison with the embodiment of the invention described above as shown in FIG. 5. With the construction shown in FIG. 9, a bezel not shown is secured by plastic packing 97 to the top end part of the case 92. A movement not shown is fastened by two screws 98 to the case 92, and a back cover not shown is fastened by four screws 99 to the case 92. A tubular antimagnetic member is disposed between the case 92 and the movement. The diameter of the movement housed in the case 92 shown in FIG. 9 and the diameter of the movement 1 in the embodiment of the invention shown in FIG. 5 are the same.

In the example of the related art shown in FIG. 9, the structures for fastening the bezel to the case 92, fastening the movement to the case 92, and fastening the back cover to the case 92 are separately designed, and the bezel, the case 92, and the back cover are therefore thicker and larger in diameter than the corresponding parts in the embodiment of the invention shown in FIG. 5. The diameter of the packing 97 disposed to the bezel and the diameter of the packing 101 disposed to the back cover are also different. This is because in order to prevent increasing the thickness of the timepiece, the fastening part (packing 97) of the bezel, the fastening part (screws 98) of the movement, and the fastening part (screws 99) of the back cover are offset from each other in the plane direction.

In the embodiment of the invention described above, however, the movement fastening units 211, bezel fastening units 214, and back cover fastening units 215 are positioned in the same radius R as shown in FIG. 5, can therefore be rendered significantly thinner than in the configuration of the related art, and the size of the timepiece is thus not needlessly greater than the diameter of the movement 1. Furthermore, while difficult with the configuration of the related art, the packing PK1 used for the bezel 4 and the packing PK2 used for the back cover 5 can have the same diameter.

Other Embodiments of the Invention

The invention is not limited to the embodiment described above and can be varied in many ways. For example, the shape of the movement and the case are not limited to being round when seen in plan view as shown in the embodiment described above, and could be a square or other polygonal shape, tonneau shaped, oval, or other shape. Regardless of the shape of the movement, the shape of the case that houses the movement is frequently made to resemble the shape of the outside contour of the movement. Substantially the same effect as the present invention can therefore be achieved by locating the movement fastening units, bezel fastening units, and back cover fastening units to a fastener reference position similar in shape to the shape of the outside perimeter of the movement.

The movement fastening units 211, bezel fastening units 214, and back cover fastening units 215 in the foregoing embodiment of the invention are formed protruding to the inside circumference side of the case member 21 from the fastener reference position X (FIG. 5), and the fastening units are substantially rendered completely inside the fastener reference position X, that is, within the same radius R, but the invention is not so limited. More particularly, disposing the movement fastening units, bezel fastening units, and back cover fastening units respectively to the fastener reference position contributes to improved space efficiency by the amount that the areas where the fastening units are formed overlap in the radial direction of the movement whether the fastening units protrude to the inside circumference side or outside circumference side of the fastener reference position, thus achieving substantially the same effect as the embodiment described above.

The movement 1 is placed into the case 2 from the crystal 3 side in the embodiment described above, but the invention is not so limited and the movement can be placed in the case from the back cover side. In this configuration the movement fastening units and bezel fastening units are disposed at the top end side of the case, and the back cover fastening units are disposed to the bottom end side of the case.

The movement fastening units, bezel fastening units, and back cover fastening units can also all be disposed to positions at the same height in the case. If the bezel fastening units 214 in the embodiment described above are at the same height as the movement fastening units 211 and back cover fastening units 215, the bezel 4 can be fastened to the bezel fastening units 214 using screws that are longer than the screws F4 (FIG. 2).

The screws F5 (FIG. 1) are also disposed to the back cover ring 51 on the inside circumference side of the packing PK2, but the screws inserted to the back cover fastening units can be located on the outside circumference side of the packing PK2. In this configuration O-rings do not need to be disposed around the shanks of the screws inserted to the back cover fastening units.

The antimagnetic member is not essential in the present invention. If the antimagnetic member 22 is not provided in the embodiment described above, the screws are inserted through spaces formed on the inside side (between the inside circumference wall of the case member and the movement) of the case member 21.

The case and back cover are rendered separately in the foregoing embodiment of the invention, but the same effect as the embodiment described above can be achieved in a timepiece having a case with the case member and back cover rendered as a single piece by fastening the movement, bezel, and case by means of movement fastening units and bezel fastening units at respectively different positions around the circumference of the case at a fastener reference position substantially similar in shape to the shape of the outside perimeter of the movement.

The best modes and methods of achieving the present invention are described above, but the invention is not limited to these embodiments. More specifically, the invention is particularly shown in the figures and described herein with reference to specific embodiments, but it will be obvious to one with ordinary skill in the related art that the shape, material, number, and other detailed aspects of these arrangements can be varied in many ways without departing from the technical concept or the scope of the object of this invention.

Therefore, description of specific shapes, materials and other aspects of the foregoing embodiments are used by way of example only to facilitate understanding the present invention and in no way limit the scope of this invention, and descriptions using names of parts removing part or all of the limitations relating to the form, material, or other aspects of these embodiments are also included in the scope of this invention.

What is claimed is:

1. A timepiece comprising:

a movement;

a substantially cylindrical case that houses the movement;

a bezel that holds the outside edge part of a crystal and is fastened to the case; and a back cover that is fastened to the opposite side of the case as the side to which the bezel is disposed;

wherein the case has a plurality of movement fastening units for fastening the movement by means of screws, a plurality of bezel fastening units for fastening the bezel by means of screws, and a plurality of back cover fastening units for fastening the back cover by means of screws;

the screws disposed to the movement fastening units, the bezel fastening units, and the back cover fastening units are substantially aligned with the axial direction of the case; and the movement fastening units, the bezel fastening units, and the back cover fastening units are respectively disposed at different positions in the circumferential direction of the case, and are disposed to a fastener reference position substantially similar in shape to the shape of the outside of the movement facing the case.

2. The timepiece described in claim 1, wherein:

an annular elastic member intervenes along the circumferential direction of the case between the bezel and the case and between the back cover and the case.

3. The timepiece described in claim 1, wherein:

the case and movement are substantially round in plan view; and the movement fastening units, the bezel fastening units, and the back cover fastening units are located at the same radial position from the plane center of the movement.

4. The timepiece described in claim 1, wherein:

at least two of the movement fastening units, the bezel fastening units, and the back cover fastening units that are adjacent in the circumferential direction of the case are mutually contiguous.

5. The timepiece described in claim 1, wherein:

a space including a portion along the axial direction of the screws disposed to the bezel fastening units is formed to the case or to the inside of the case when the movement is housed in the case.

6. The timepiece described in claim 1, further comprising:

a case member including the case, the movement fastening units, the bezel fastening units, and the back cover fastening units; and an antimagnetic member disposed on the side of the case member facing the movement;

wherein the antimagnetic member is formed to substantially fill the space between the movement and the case member except in the parts where the movement fastening units, the bezel fastening units, and the back cover fastening units are disposed.

7. The timepiece described in claim 2, wherein:

the diameter of the elastic member intervening between the case and the bezel, and the diameter of the elastic member intervening between the case and the back cover, are the same.

8. The timepiece described in claim 1, wherein:

the back cover includes an annular back cover ring and a back crystal disposed to an inside circumference part of the back cover ring; and the back cover ring is disposed to a position hiding the back cover fastening units.

9. The timepiece described in claim 1, further comprising:

an engaging unit that protrudes in the axial direction of the case from at least one of the bezel and the back cover, and engages a part of the case in the circumferential direction of the case.

10. The timepiece described in claim 9, wherein:

a space is formed to the case including a portion along the axial direction of the screws disposed to one or both of the movement fastening units and bezel fastening units.

11. A timepiece comprising:

a movement;

a case that has a substantially cylindrical case member and a cover, and houses the movement; and a bezel that holds the outside edge part of a crystal and is fastened to the case member;

wherein the case member has a plurality of movement fastening units for fastening the movement by means of screws, and a plurality of bezel fastening units for fastening the bezel by means of screws;

the screws disposed to the movement fastening units and the bezel fastening units are substantially aligned with the axial direction of the case member; and the movement fastening units and the bezel fastening units are respectively disposed at different positions in the circumferential direction of the case, and are disposed to a fastener reference position substantially similar in shape to the shape of the outside of the movement facing the case member.

* * * * *